United States Patent [19]

Graybill

[11] 3,940,460

[45] Feb. 24, 1976

[54] AIR-VALVE TYPE CARBURETOR

[76] Inventor: Clinton L. Graybill, P.O. Box 148, Superior, Mont. 59872

[22] Filed: Feb. 14, 1974

[21] Appl. No.: 442,383

[52] U.S. Cl. ..... 261/40; 261/62; 261/72 R; 261/52; 261/121 A

[51] Int. Cl.[2] ..... F02M 7/06; F02M 7/24

[58] Field of Search ..... 261/40, 62, 72 R, 121 A, 261/52

[56] References Cited

UNITED STATES PATENTS

| | | | |
|---|---|---|---|
| 1,181,356 | 5/1916 | Thompson et al. | 261/62 |
| 1,307,665 | 6/1919 | Guider | 261/62 |
| 1,394,452 | 10/1921 | Taft | 261/62 |
| 1,522,920 | 1/1925 | Slayton | 261/40 |
| 1,803,150 | 4/1931 | Stokes | 261/72 R |
| 1,805,763 | 5/1931 | Ensign | 261/72 R |
| 1,916,062 | 6/1933 | Memini | 261/121 A |
| 2,134,877 | 11/1938 | Jedrzykowski | 261/121 A |
| 2,557,111 | 6/1951 | Jorgensen et al. | 261/DIG. 67 |
| 2,796,243 | 6/1957 | McDuffie | 261/72 R |
| 2,841,374 | 7/1958 | Raynor | 261/50 A |
| 3,096,386 | 7/1963 | Seldon | 261/72 R |
| 3,284,063 | 11/1966 | Bickhaus et al. | 261/50 A |

*Primary Examiner*—Tim R. Miles
*Attorney, Agent, or Firm*—Wells, St. John & Roberts

[57] ABSTRACT

An air valve type carburetor is described having an enlarged mixing chamber in an induction duct. Fuel is supplied to the mixing chamber at a plurality of annularly spaced locations about the circumference of the mixing chamber. An air valve having an umbrella-shaped disc is positioned at the entrance to the mixing chamber for regulating the flow of the air into the mixing chamber in response to the vacuum pressure prevailing in the mixing chamber. The air valve is designed to direct the air radially outward over the disc and along the periphery of the mixing chamber and to create a pressure depression behind the valve to cause the air to flow radially inward in a turbulent eddy into the central portion of the mixing chamber to thoroughly mix the fuel with the air. Fuel is metered to the mixing chamber in amounts responsive to the manifold pressure, atmospheric pressure and mixing chamber pressure. Additionally, the fuel is premixed with air prior to discharge into the mixing chamber. The fuel delivery system includes a plurality of annular chambers about the induction duct with one chamber serving as a fuel well with a plurality of fuel tubes extending from the well to the mixing chamber.

21 Claims, 8 Drawing Figures

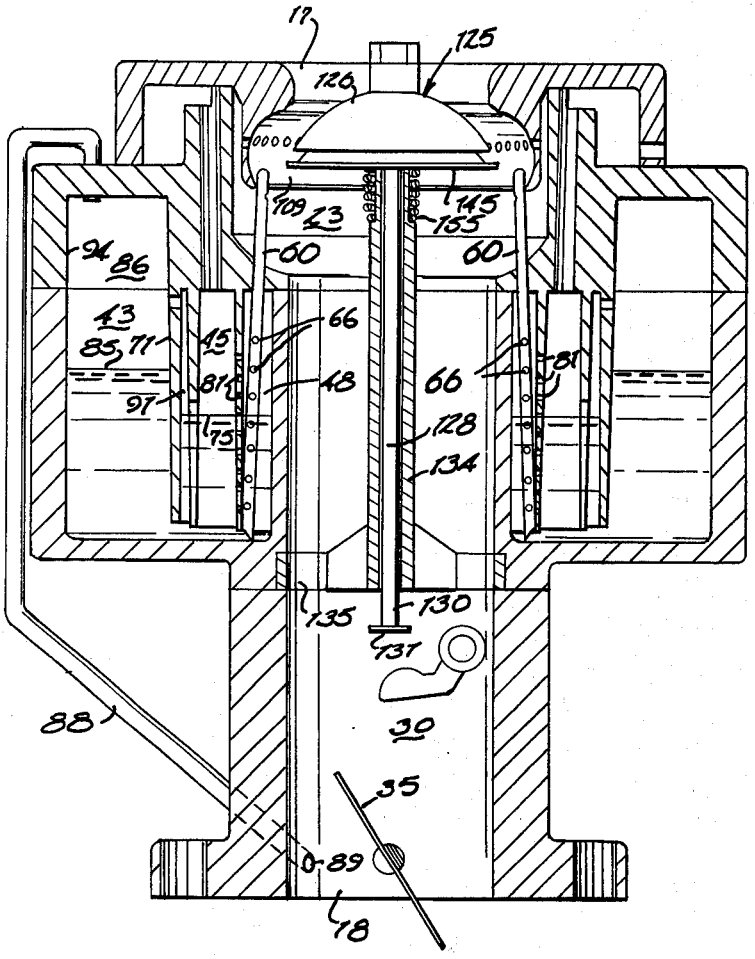
FIG 7
FIG 8
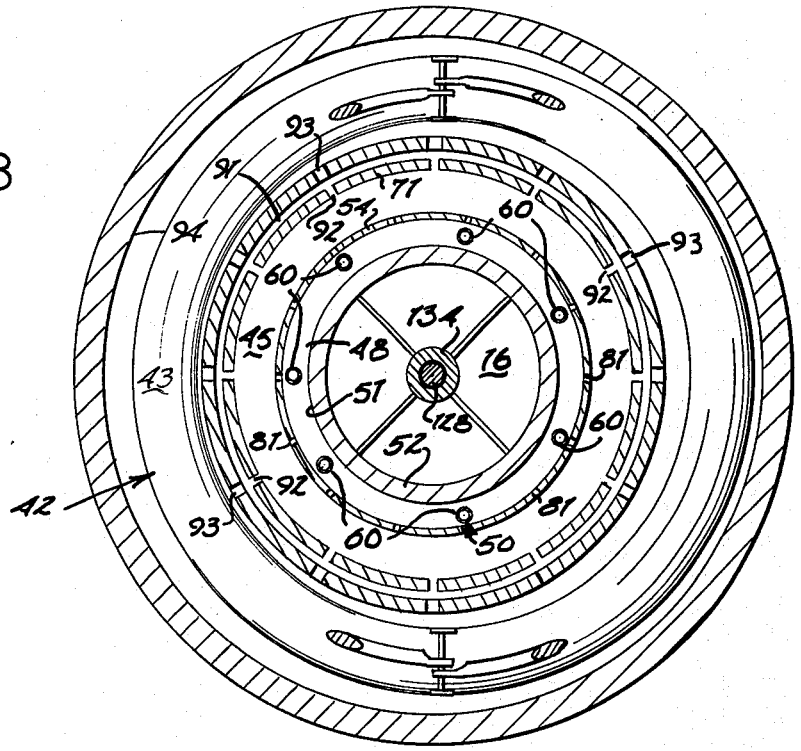

AIR-VALVE TYPE CARBURETOR

BACKGROUND OF THE INVENTION

This invention relates to carburetors for internal combustion engines and more particularly to air-valve type carburetors for internal combustion engines that are utilized to propel vehicles such as automobiles.

Most present day automobile carburetors are designed with a venturi to create a vacuum pressure in the emission chamber to pull fuel from a fuel reservoir. The venturi, by its fixed nature, operates at maximum efficiency over a small range of engine speeds. Furthermore a different size venturi is generally required for different size engines. Seldom is the automobile operated in only a small range of speeds. Consequently, various complicated venturi arrangements including multiple venturi tubes have been included in carburetors in an attempt to make the carburetor more efficient over a wide range of operating conditions. A venturi is generally most ineffective at slow speeds in which the velocity through the venturi is minimal. Consequently, special idle jets have been incorporated in carburetors to pass additional fuel to the engine at low speeds. At higher speeds, the fuel from the special jet is not required and provides a richer mixture then is needed. Such a loss is particularly noted at high speeds during deceleration.

Over the years additional features have been added to carburetors to overcome certain limitations in a fixed venturi carburetor. One limitation is presented when the carburetor is moving at a slow speed and the driver desires to quickly accelerate the automobile to pass another vehicle. Quick depression of the throttle pedal, causes the throttle valve to rapidly open. This causes additional amounts of air to flow through the venturi without substantially increasing the vacuum pressure to draw additional fuel. Consequently it is not infrequent that the engine would stall on the lean mixture. To overcome such a limitation, accelerator fuel pumps have been incorporated in carburetors to pump additional fuel into the mixing chamber when the throttle is depressed rather rapidly. However, such a compromise results in the loss of fuel when the vehicle is traveling at high speeds and the accelerator pump is temporarily released and then depressed again. The pump adds the additional fuel to the engine which is wasted since the high air velocity through the venturi is sufficient to pull enough fuel into the cylinders to accomplish the objective without the necessity of the fuel pump. Consequently, an additional feature to overcome one limitation frequency causes additional inefficiencies over other operating conditions.

Another limitation is encountered when the vehicle is traveling at an intermediate speed with the throttle almost fully depressed. This condition occurs when the automobile is climbing a hill or encounters a heavy headwind. Under such conditions, the velocity in the venturi is insufficient to pull the fuel. To compensate for this problem, many carburetors utilize metering rods to delivery more fuel to the venturi. All of these additional features are attempting to compensate for the inefficiencies of the venturi over the full range of operating conditions. Ideally, the carburetor for an automobile should operate at high efficiencies over a full range of engine operating conditions.

Conventional air-valve type carburetors have been utilized in which the system attempts to maintain a constant air velocity across a jet fuel orifice independently of the throttle valve position and engine speed. Such carburetors generally attempt to vary the size of the fuel jet in accordance with the amount of air entering the carburetor to provide a correct "air-fuel ratio". However engines having such air valve carburetors are generally difficult to start and operate at idling speeds. Plus special fuel metering circuits are generally required to provide a richer mixture when quick acceleration is required.

Each additional feature added to the carburetor makes it more complicated and more susceptible to plugging necessitating frequent maintenance and adjustment. The number of moving parts in carburetors has increased substantially over the years making the carburetors extremely complicated and more expensive to manufacture.

One of the noted problems of prior art venturi and air valve carburetors in addition to the foregoing is the inability to efficiently and effectively vaporize and mix the fuel with the air prior to discharge into the intake manifold of the engine over the full range of operating conditions.

One of the principal objects of this invention is to provide a very simple carburetor of the air-valve type in which the fuel is efficiently and effectively mixed with the air prior to discharge into the intake manifold to increase the efficiency of the combustion in the combustion chamber.

An additional object of this invention is to provide a very simple carburetor with no moving parts in the fuel metering system in which the fuel air ratio may be varied over the full range of the engine in operating conditions.

A further object of this invention is to provide a very simple air valve carburetor in which all of the fuel is added through a single fuel circuit over the full range of the operating conditions of the engine.

An additional object of this invention is to provide an air type valve carburetor that may be utilized with minimum adjustments for various size engines.

A further object of this invention is to provide an air valve type carburetor that does not have an idle jet, an accelerator pump or a needle valve or jet.

An additional object of this invention is to provide a carburetor not having a venturi or a variable size fuel nozzle.

A further object of this invention is to provide an air valve type carburetor in which the amount of fuel may be varied without having to increase or decrease the size of the fuel jets or nozzles in the mixing chamber.

A further object of this invention is to provide an air valve type carburetor in which the fuel is uniformly discharged into the air at multiple locations and is effectively mixed prior to discharge into the intake manifold.

An additional object of this invention is to provide a carburetor of the air valve type that is capable of automatically adjusting to different atmospheric pressures to enable the engine to adjust to various altitudes.

A still further object of this invention is to provide a carburetor that is extremely simple to manufacture and very easy to maintain.

These and other objects and advantages of this invention will become apparent upon reading of the following detailed description of a preferred embodiment.

BRIEF DESCRIPTION OF THE DRAWINGS

A preferred embodiment of this invention is illustrated in the accompanying drawings, in which:

FIG. 7 is a view similar to FIG. 1 except showing the carburetor in an alternate operating condition (the float mechanism is excluded to simplify the view for illustration purposes); and FIG. 8 is a horizontal cross-sectional view taken along line 8—8 in FIG. 1.

DESCRIPTION OF A PREFERRED EMBODIMENT

A carburetor for internal combustion engines is shown in the accompanying drawings and is generally designated with the numeral 10. The carburetor is designed for mounting on a vehicle internal combustion engine and interconnected to a manifold of the engine. Although the carburetor illustrated is shown in a down draft configuration, it should be understood that several other configurations and embodiments may be utilized without deviating from the principles of the invention.

Figure 6:
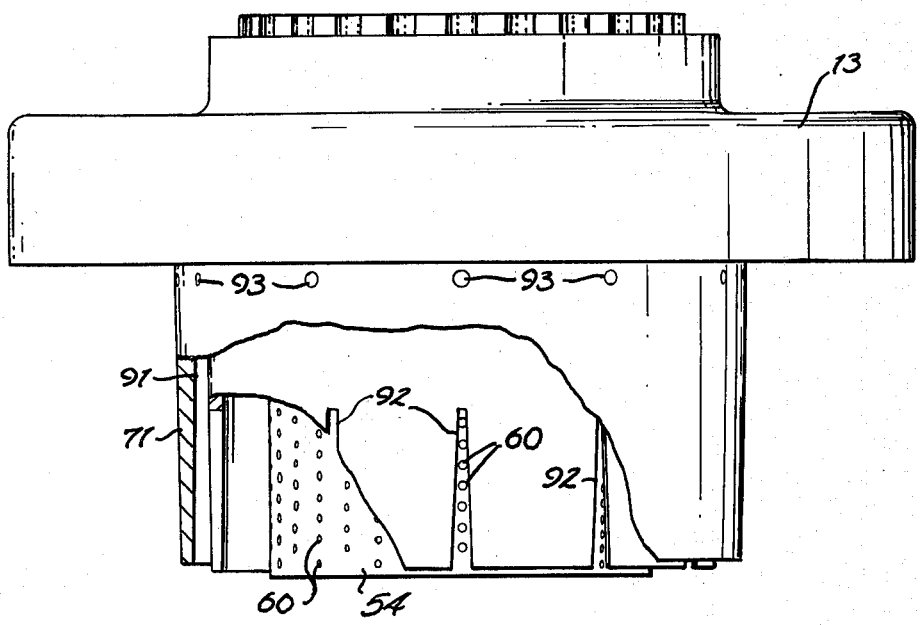
FIG. 6 is an isolated side view showing cutaway sections of a fuel metering system for the carburetor.

The carburetor 10 has a general body 11 which consists of a lower casting 12, a top casting 13 and an intake casting 14. The top casting 13 is shown separately in FIG. 6.

Figure 3:
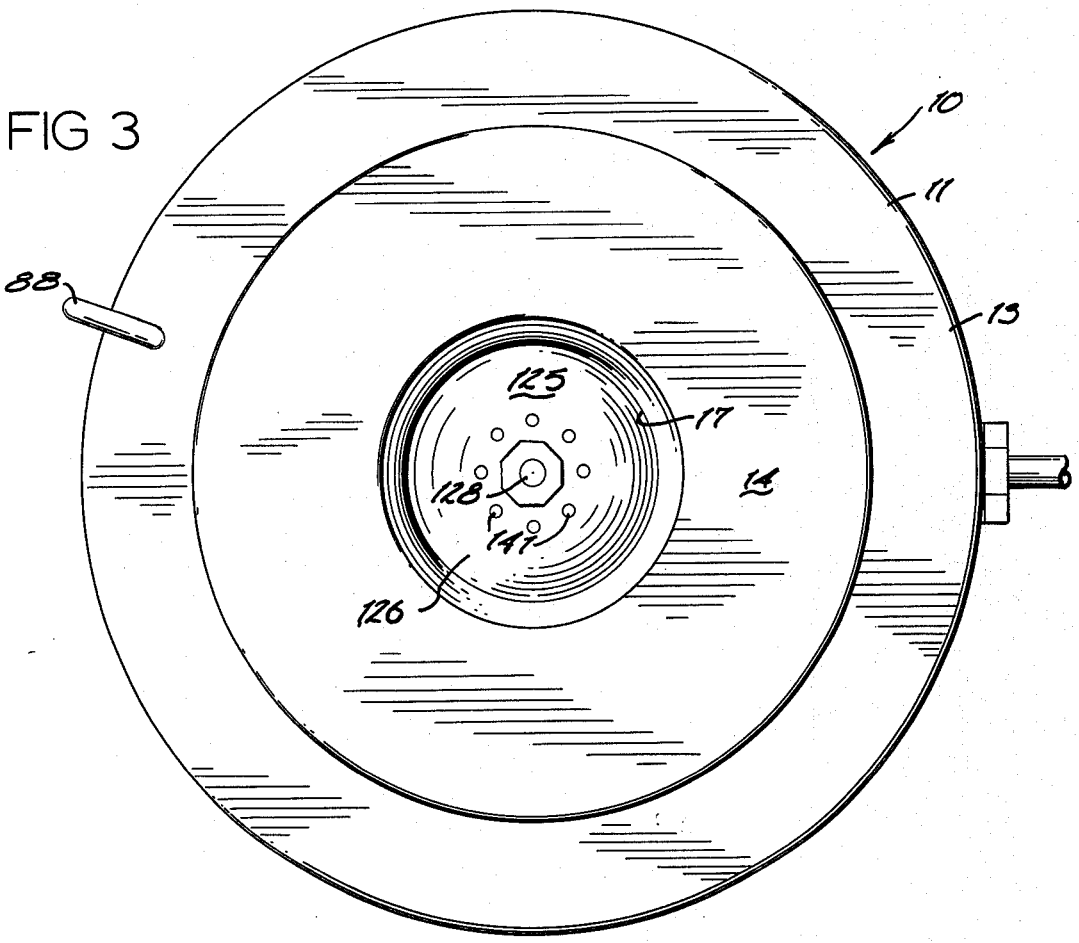
FIG. 3 is a plan view of the carburetor.

The body 11 includes an induction duct 16 that extends through the body communicating with the manifold of the engine. The induction duct 16 has an intake opening 17 at one end of the induction duct and a carburetor outlet opening 18 which communicates with the engine manifold. The intake duct 16 has a cylindrical section 20 with a side wall 21. The cylindrical section 20 has a desired radius. Within the cylindrical section 20 is an enlarged section forming a mixing chamber 23. The mixing chamber may be subdivided for illustration purposes into annular cavity 24*a* that communicates with a central cavity or space 24*b* (FIG. 3). The mixing chamber is surrounded by a peripheral wall 25 having a greater radius than wall 21. The mixing chamber 23 has an entrance 26 and an exit 27 within the induction duct 16.

Downstream of the mixing chamber 23 is a mixing outlet section 30 having a side wall 31. Preferably the mixing outlet section 30 is also of a cylindrical configuration, and has the same area cross section as section 20. However the shape of the section 30 is not particularly important and may be of various shapes and curvatures to accommodate the particular engine manifold.

The carburetor 10 has a throttle valve 35 mounted in the induction duct 16 specifically in the mixture outlet section 30, for regulating the flow of the mixture (fuel and air) into the engine manifold. The particular throttle valve shown in the carburetor is of a butterfly type having a plate 36 that is mounted on a central transfer shaft 37. The shaft 37 is connected through linkages to a throttle pedal or the like of the vehicle.

The carburetor 10 has a fuel delivery means generally designated with the numeral 40 (FIG. 1) for delivering fuel in metered amounts into the mixing chamber 23. The body 11 includes a fuel bowl 41 having various compartments or chambers which will be described in more detail.

The feul delivery means includes a metering control reservoir or chamber 42 communicating with and controlling a fuel well 48. The metering control reservoir 42 includes a manifold pressure control chamber 43 and an atmospheric pressure control chamber 45. Fuel from the fuel well 48 is communicated to the mixing chamber through a mixing chamber fuel line 50. The fuel line 50 is designed to deliver the fuel to angularly spaced locations in the annular space 24*a* to provide a uniform distribution of the fuel into the mixing chamber 23 at a plurality of circumferential locations.

The fuel well 48 is preferably formed by an angular cavity 51 (FIG. 8) that is positioned concentrically with respect to the mixing chamber 23. The fuel well 48 has an annular inside wall 52 and an annular outside wall 54. The liquid level in the well 48 is designated with the numeral 55 with an air space 56 above the liquid level. The air space 56 is vented to the mixing chamber through vent lines 58 that extend into the mixing chamber at angularly spaced locations. The vent lines 58 are designed to apply the vacuum existing in the mixing chamber 23 to the air space 56.

The mixing chamber fuel line 50 preferably includes a plurality of tubes 60 that are angularly spaced about the mixing chamber in which each of the tubes have an end 61 that extends downwardly into the fuel well 48 terminating below the fuel level 55. Each tube 60 has an upper end 62 that extends into the mixing chamber terminating in the annular space 24*a*. The upper end 62 has a port or nozzle 63 that is directed radially inward toward the axis of the mixing chamber 23. The tubes 60 direct the fuel from the fuel well 48 into the mixing chamber at the angularly spaced locations distributing the fuel evenly in the annular space 24*a*.

The fuel delivery means 40 further includes an air and fuel premixing means for premixing air with the fuel prior to delivering the fuel to the mixing chamber 23. The air and fuel premixing means includes a plurality of vertically spaced apertures or holes 66 formed in the tubes 60 for bleeding air from the air space 56 into the tubes 60 for mixing with the fuel as the fuel is distributed in the mixing chamber. The vertically spaced apertures or holes 66 may be referred to as variable flow restriction means that is responsive to the fuel level 55 in the fuel well 48 for varying the amount of air mixed with the fuel. As the fuel level 55 moves downwardly more holes are uncovered to bleed additional amounts of air into the tubes thereby decreasing the fuel to air ratio. When the fuel level 55 raises, it covers additional apertures 66 decreasing the amount of air bled into the tubes 60, thereby increasing the fuel to air ratio.

The atmospheric pressure control chamber 45 is annular in shape having annular wall 54 in common with the fuel well 48 (FIG. 8). The chamber 45 has an outer wall 71. Passage 73 (FIG. 1) extends between the atmospheric pressure control chamber 45 and the fuel well 48 below the liquid levels in the respective chambers for communicating fuel therebetween. Fuel in the chamber 45 provides a fuel level designated with the number 75 with an air space 72 thereabove. A conduit line 74 extends from the air space 72 to the atmosphere to apply atmospheric pressure to the air space 72. In the particular configuration shown, the annular wall 54 is supported from above and terminates short of the bottom of the fuel bowl and thereby defines the passage 73 for communicating fuel between the two chambers 45 and 48.

The fuel delivery means includes a first fuel level fluctuation control means for controlling the fluctuation of the fuel level 55 within the desired limits. The first fluctuation control includes a plurality of vertically spaced holes 81 formed in the wall 54 that extends between chambers 45 and 48. The holes extend both above and below the average liquid level 75. The plurality of vertical holes 81 may be referred to as a variable flow restriction means for bleeding air from chamber 45 to the fuel well 48 in response to fuel level 75. The amount of air bled from chamber 45 to 48 depends upon the height of the fuel level 75 in relationship to the holes 81. As the fuel level 75 moves downwardly, it uncovers additional holes 81 bleeding additional amounts of air into the fuel well 48 and thereby limiting the upward movement of the liquid level 55. When the liquid fuel level 75 moves upwardly, it covers additional holes 81 decreasing the amount of air bled from the chamber 45 to fuel well 48. Such a system may be referred to as an automatically fuel level self-regulating system. Additionally, such a system automatically adjusts for differences in atmospheric pressure that may be found at various altitudes. Consequently, at high altitudes where the atmospheric pressure is less, then the fuel level 75 will be higher then at lower elevations where the atmospheric pressure is greater. Consequently the fuel level 55 is controlled by atmospheric conditions which in turn control the amount of air that is bled into the tubes and thereby adjusting the fuel air ratio.

The manifold pressure control chamber 43 likewise is preferably angular in shape concentrically about the mixing chamber 23 having wall 71 in common with the chamber 45. The chamber 43 has an outside wall 94. The fuel forms a fuel level 85 within the chamber with an air space 86 formed immediately thereabove. Fuel flows between the chambers 43 and 45 through a passage 87 that extends between the chambers below the respective fuel levels. In a preferred embodiment, the wall 71 is supported from above and extended downwardly into the fuel bowl terminating short of the bottom of the fuel bowl to create a passage 87 between chambers 43 and 45.

A manifold pressure line 88 extends from the air space 86 to an opening 89 in the induction duct 16 immediately below the throttle valve 35 as illustrated in the drawings. The purpose of the manifold pressure line 88 is to communicate the manifold pressure immediately below the throttle valve to the air space 86 in the manifold pressure control chamber 43.

The fuel delivery means system includes a second fuel level fluctuation control means for controlling the fluctuation of the fuel level 85. The second fluctuation control means includes an annular passage 91 formed in the wall 71 that extends from elongated openings 92 exposed to the chamber 45 and elevated openings 93 exposed to chamber 43. The elongated openings 92 communicate with the chamber 45 normally below the fuel level 75. The opening 93 however communicates with the chamber 43 normally above the fuel level 85. The second fluctuation control prevents fuel level 85 from exceeding a desired upward elevation. As the manifold pressure decreases below the throttle valve, fuel level 85 rises causing fuel levels 55 and 75 to descend. When the fuel level 75 exposes the openings 92, air is bled from chamber 45 to the inner passage 91 and through the openings 93 to the air space 86 bleeding atmospheric air into the air space and thereby limiting the upward movement of the fuel level 85 in the chamber 43. Both fuel level fluctutation control means provide a very important balancing between the fuels levels 55, 75 and 85 to control the amount of fuel and the fuel-air premixing ratio into the mixing chamber to accommodate the engine over a wide range of operating conditions.

The fuel delivery means includes a fuel supply means 96 for supplying fuel to the fuel bowl 41. In the configuration illustrated, the fuel supply system includes a float valve 97 residing in the chamber 43. The float valve 97 includes an annular float 98 that is mounted in chamber 43 and is connected to the valve 97 through linkage 100.

It should be noted that the volume of chamber 43 is greater than the volume of either the fuel well 48 or the atmospheric pressure control chamber 45. Consequently, a rather small change in fuel level 85 will be amplified in a larger change of fuel levels 55 and 75. This provides for a very quick and positive response to changing load and speed conditions of the engine.

Figure 4:
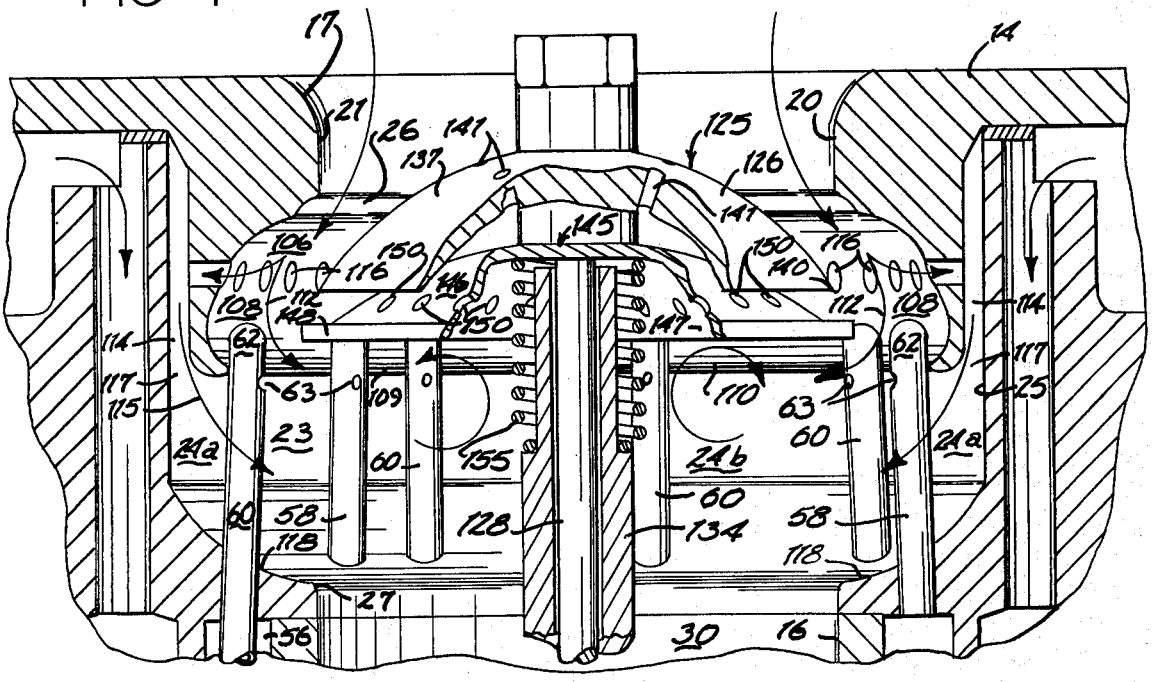
FIG. 4 is an enlarged vertical cross-sectional view of a mixing chamber of the carburetor.
Figure 5:
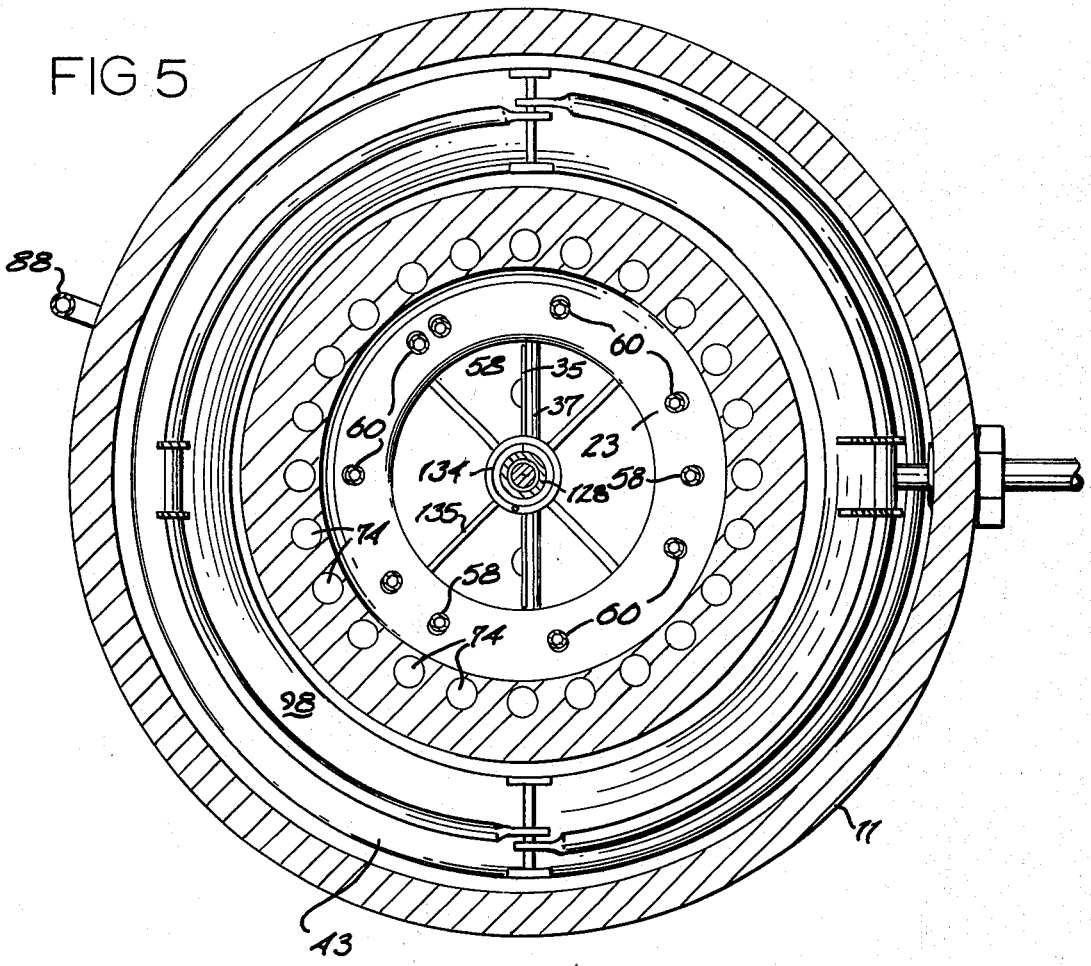
FIG. 5 is a cross-sectional view taken along line 5—5 in FIG. 1.

The mixing chamber 23 (FIG. 4) includes in the entrance surface 106 that extends radially outward and downward in a concave curve. The mixing chamber includes means 108 for directing the air over the tube ends 62 and about the ports or nozzles 63. The means 108 in the preferred embodiment includes an annular deflector 109 which may be formed as an integral component of the intake casting 14 or may be a separate component mounted within the mixing chamber 23. The deflector 109 has a concave front surface 110 that extends downwardly and radially inward for directing the air in a main stream (depicted by arrow 112) inwardly over the fuel tubes 60 and toward the center space 24*b* of the mixing chamber. Air passage 114 is formed behind the deflector 109 for receiving a secondary air stream (depicted by arrow 115) and for directing the air along the peripheral wall 25 to assist in starting the engine and for providing sufficient air for idling operations. The air passage 114 may be formed in the body 11 immediately behind deflector 109. The air passage 114 has an intake opening 116 communicating with the induction duct at entrance 26. Alternatively the opening 116 may be upstream of the mixing chamber. The air passage 114 has an exit opening 117 that communicates with the mixing chamber 23. The mixing chamber has an exit surface 118 that extends in a concave curve from the mixing chamber to the mixture outlet section 30. The exit surface 118 is concave to minimize turbulence along the peripheral wall 25 or in the annular space 24*a*. In the preferred embodiment, the cross-sectional area of the mixing chamber is approximately equal to twice the cross-sectional area of section 20.

A very important provision of the carburetor is an air valve 125. The air valve is mounted axially within the induction duct 16 for controlling the flow of air into the mixing chamber.

The air valve 125 has a valve disc 126 that is movably mounted in the entrance 26 for opening and closing the entrance for controlling the amount of air passing into the mixing chamber. The valve disc 126 is mounted on a valve stem 128 which is slidably mounted in the cylindrical guide housing 134. The stem 128 is positioned along the axis of the mixing chamber. A web 135 mounts the cylindrical guide housing 134 coaxially within the mixing chamber.

Preferably the valve disc 126 (FIG. 4) has an umbrella or dome shape with a convex top surface 137 and a concave lower surface 138 that extend radially outward to a periphery 140. The radius of the disc is sufficient to substantially enclose the entrance when the air valve is in the closed position. The valve disc has a plurality of apertures 141 (FIG. 3) for permitting the flow of a small amount of air through the disc into the mixing chamber when the air valve is in the closed position to assist in starting the engine and to minimize the formation of a dead air space in the mixing chamber immediately behind the disc.

In the preferable configuration, the valve includes an air deflector 145 mounted on the valve stem spaced from but adjacent to the valve disc 126. The purpose of the deflector 145 is to direct the air that is emitted through the disc apertures 141 radially outward toward the peripheral wall 25 and against the mixing chamber deflector 109. The air deflector 145 has an umbrella-shape or dome-shape with a convex upper surface 146 and a concave lower surface 147 extending to a peripheral edge 148. Preferably, the air deflector permits a portion of the air that flows through the apertures 141 to flow through the apertures 150 to minimize the formation of a dead air space below the valve disc.

The valve stem has a lower end 130 that extends downwardly through the cylindrical housing 134 terminating in a foot 131. The air valve includes a compression spring 155 that is mounted on the cylindrical 134 for biasing the valve disc 126 upwardly to close the entrance 26. The compression spring 155 is calibrated to open the entrance when a desired level of vacuum pressure prevails in the mixing chamber 23 and to permit the valve disc to float to maintain the vacuum pressure within the mixing chamber at the desired vacuum level.

For some engines, it may be desirable to utilize a spring that has a varying spring constant so as to progressively increase the vacuum pressure in the mixing chamber as the air valve is progressively opened. Spring 155 is principally designed to permit the valve disc 126 to float throughout a major portion of the operating conditions of the engines to maintain the vacuum pressure in the mixing chamber 23 at a desired level.

For some engines, it may be desirable to include an override system for directly moving the valve discs 126 to desired positions for limited portions of the operating range. This is accomplished by utilizing a cam 160 that is mounted in the induction tube 16 for engaging the foot 131. The cam 160 is operatively connected through linkage (not shown) to the throttle valve 35. A dash pot (not shown) may be operatively connected between the throttle valve 35 and the cam 160. For some engines, it is desirable to have the linkage designed to move the cam 160 into engagement with the foot 131 to hold the air valve closed during the starting and idling operations. Additionally, the dash-pot may be provided between the cam 160 and the throttle valve operation so as to prevent the air valve from opening as rapidly as the throttle valve when rapid acceleration is desired. For many engines such a system is not needed, however it is shown as an alternative and may be needed for some engines for limited operating conditions.

Figure 1:
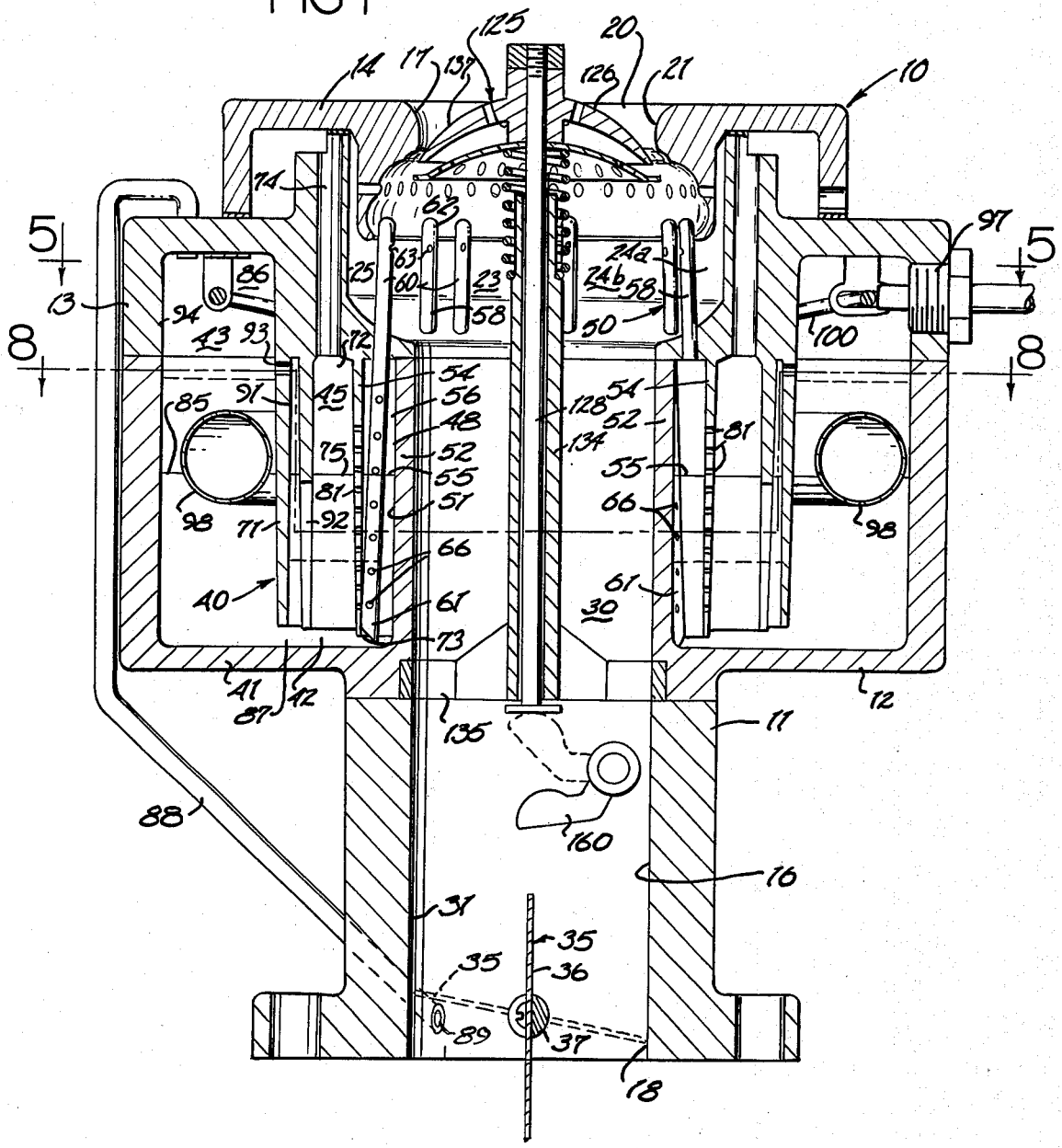
FIG. 1 is a vertical cross-sectional view of a carburetor of the preferred embodiment illustrating the internal features of the carburetor.
Figure 2:
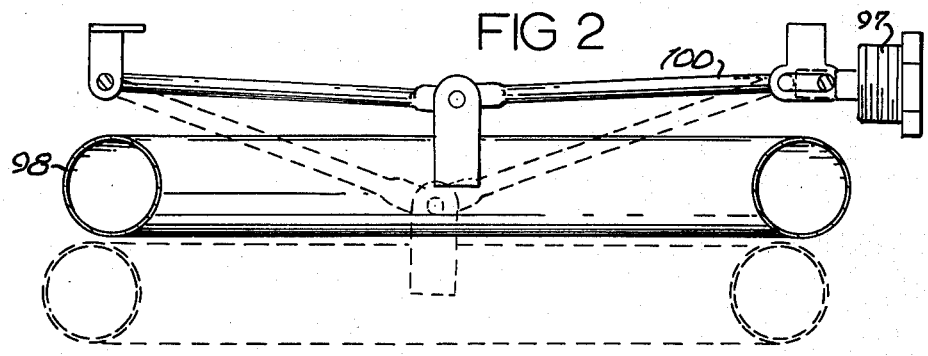
FIG. 2 is an isolated vertical cross-sectional view of a float mechanism for a fuel reservoir in the carburetor.

Under starting conditions, the manifold pressure is generally equally applied through the manifold pressure line 88 to the air space 86 and through the mixing chamber 23 to the air space 56 in the fuel well 48. Consequently, the fuel levels 55 and 85 are approximately the same as illustrated in FIG. 1. Air is drawn through the apertures 141 and directed outwardly by the deflector 145 across the mixing chamber deflector 109 with a portion of the air passing through the air passage 114. Fuel is drawn through the tubes 60 into the mixing chamber in a rather rich mixture. As soon as the engine starts, the throttle valve approaches the closed position applying manifold pressure to the air space 86 which immediately raises the liquid level 85 in the chamber 43 and lowers the fuel level 55 in the fuel well 48 and fuel level 75 in the chamber 45. The lowering of the fuel level 55 automatically reduces the fuel-air ratio to provide a leaner idling mixture.

When accelerating at low engine speeds with the throttle valve 35 open, the manifold vacuum pressure decreases thereby lowering the fuel level 85 and raising the fuel level 55 to cover additional apertures 66 and increase the fuel flow to the mixing chamber 23. As the engine speed increases to the speed corresponding to the throttle setting, the manifold pressure decreases to raise the fuel level 85 and lower the fuel level 55 to increase the amount of air bled through the holes or aperture 66 and thereby provide a progressively leaner fuel mixture in the mixing chamber.

Under increased load conditions which are normally encountered when the vehicle is ascending a hill or encountering a heavy headwind, the carburetor automatically responds to provide increased fuel-air ratio by supplying the reduced vacuum pressure from the manifold to the chamber 43 to lower the fuel level 85 in the chamber 43 and to raise the fuel level 55 in the fuel well 48 to decrease the amount of air bled or premixed with the fuel.

When the vehicle is moving down a hill or with a tailwind, the throttle valve is further closed than normal. The increased vacuum pressure in the manifold causes the fuel level 85 to rise and to correspondingly lower the fuel level 55 to bleed additional amounts of air into the mixing chamber and to thereby reduce the fuel-air mixture.

As a vacuum pressure is applied to the mixing chamber 23, the valve disc 126 begins to open permitting air to flow radially outward to the periphery of the disc 26 and then downwardly along the peripheral wall 25 in space 24*a* and then inward by deflector 109 across the nozzles or ports 63 toward the central space 24*b*. The specific design of the valve disc creates a pressure depression immediately underneath the disc 126 causing the air and fuel to flow inwardly in a turbulent eddy motion to greatly increase evaporation of the fuel and increase the mixing of the air and fuel to provide a very efficient and effective mixture before the mixture is passed to the manifold. The secondary air passes through the air passage 114 along the peripheral wall 25 to prevent turbulation of the air and fuel along the peripheral wall and to assist in the improvement of the main stream 112 past the ports 63.

Because of the annular nature of the chamber 45 and the fuel well 48, the fuel delivery system is not adversely effected by acceleration or deceleration forces including turning forces of the vehicle. It should be noted that the chambers 45 and 48 need not be annular in shape if a multiple of chambers are annularly spaced about the mixing chamber 23. The preferred embodiment shown however is inexpensive to construct and maintain.

It has been found that by utilizing this carburetor on conventional engines, that a 40% increase in fuel savings can be obtained with an increase in power. An additional benefit obtained is that the engine runs at a lower temperature which reduces the formation of nitrogen oxides. These are additional advantages over and above the very efficient operation of the carburetor over a very large range of engine speeds and operating conditions. It should be noted that the carburetor has no special idle jet, accelerator pump or metering valve or fixed venturi. The fuel system is extremely simple and is not easily plugged by foreign material.

It should be understood that the above described embodiment is simply illustrative of the principles of this invention and that numerous other embodiments may be readily devised by those skilled in the carburetor art, without deviating therefrom. Therefore only the following claims are intended to define this invention.

What I claim is:

1. A carburetor for a vehicle internal combustion engine, comprising:

a carburetor body having an induction duct passing therethrough in which the induction duct has an intermediate segment defining a mixing chamber in which air and fuel are mixed prior to passage of the mixture to the engine;

said mixing chamber having a peripheral wall;

a fuel delivery means communicating with the mixing chamber having a plurality of fuel nozzles at fuel discharge locations angularly spaced about the peripheral wall of the mixing chamber for delivering metered amounts of fuel into the mixing chamber at the plurality of locations;

wherein the fuel delivery means includes (1) a fuel reservoir vented to the atmosphere, (2) a fuel well in liquid communication with the fuel reservoir and in vapor communication with the mixing chamber, and (3) a fuel line between the well and the nozzles for supplying fuel to the nozzles in which the amount of fuel supplied to the mixing chamber varies in relation to the difference between the atmospheric pressure and the mixing chamber vacuum pressure as reflected by the difference in fuel levels between the fuel reservoir and the fuel well;

a throttle valve mounted in the induction duct downstream of the mixing chamber for regulating the flow of said mixture to the engine;

a pressure sensitive air valve mounted in the induction duct at an entrance to the mixing chamber for regulating the amount of air flow into the mixing chamber in relation to the magnitude of vacuum pressure prevailing in the mixing chamber; and said air valve having a movable disc centrally mounted in the mixing chamber entrance for directing the air entering the mixing chamber in a path radially outward to the periphery of the disc and into the mixing chamber along the peripheral wall of the mixing chamber past the plurality of fuel discharge locations to receive fuel and for creating a pressure depression in the mixing chamber behind the valve disc to cause the air to flow radially inwardly from the peripheral wall forming a turbulent eddy in the pressure depression to thoroughly mix the fuel and air.

2. The carburetor as defined in claim 1 further comprising means formed in the mixing chamber for assisting in directing the flow of the air radially inward behind the valve disc.

3. The carburetor as defined in claim 1 wherein the air valve has spring means for biasing the valve disc toward a closed position in the mixing chamber entrance.

4. The carburetor as defined in claim 3 wherein the air valve disc has apertures formed therein for bleeding a portion of the air through the valve disc into the mixing chamber when the valve disc is closed to provide sufficient air in the mixing chamber for engine idling.

5. The carburetor as defined in claim 4 wherein the air valve has an air deflector immediately behind the valve disc for directing the portion of the air bled through the disc apertures to the periphery of the deflector and along the peripheral wall past the fuel discharge locations to receive fuel.

6. The carburetor as defined in claim 5 wherein the deflector has apertures formed therein to bleed a portion of the air into the mixing chamber to bleed air into the pressure depression in the mixing chamber behind the valve disc.

7. The carburetor as defined in claim 1 wherein the fuel nozzles discharge fuel into the mixing chamber at a desired longitudinal location in the induction duct and wherein the air valve disc is movable mounted in the mixing chamber entrance in relation to the longitudinal locations for directing the air along the peripheral wall at the longitudinal location when the air valve is open.

8. The carburetor as defined in claim 7 wherein the fuel nozzles project into the mixing chamber terminating spaced radially inward from the peripheral wall and radially outward from the air valve to permit the air to flow around the nozzles.

9. A carburetor for a vehicle internal combustion engine, comprising:

a curburetor body having an induction duct passing therethrough in which the induction duct contains a cylindrical longitudinal section of a desired radius with an enlarged segment defining a mixing chamber having a peripheral wall with a larger radius then the cylindrical section;

a fuel delivery means communicating with the mixing chamber haaving a plurality of fuel nozzles at angularly spaced fuel discharge locations about the peripheral wall for delivering metered amounts of fuel to the mixing chamber at the angularly spaced locations;

wherein the fuel delivery means includes (1) a fuel reservoir vented to the atmosphere, (2) a fuel well in liquid communication with the fuel reservoir and in vapor communication with the mixing chamber, and (3) a fuel line between the well and the nozzles for supplying fuel to the nozzles in which the amount of fuel supplied to the mixing chamber varies in relation to the difference between the atmospheric pressure and the mixing chamber vacuum pressure as reflected by the difference in fuel levels between the fuel reservoir and the fuel well;

a throttle valve mounted in the induction duct downstream of the mixing chamber for regulating the flow of said mixture to the engine;

a pressure sensitive air valve mounted in the induction duct for regulating the amount of air flow into the mixing chamber in relation to the magnitude of vacuum pressure prevailing in the mixing chamber; and said air valve having an umbrella-shaped valve disc mounted in the induction duct for axial movement in response to the vacuum pressure prevailing in the mixing chamber for regulating the flow into the mixing chamber and for channeling the air entering the mixing chamber into a stream flowing radially outward to the periphery of the disc and along the peripheral wall of the mixing chamber past the ful discharge locations to suspend fuel therein and for creating a pressure depression in the mixing chamber behind the valve disc to cause the stream to flow radially inward from the peripheral wall to form a turbulent eddy in the pressure depression to thoroughly mix the fuel and air.

10. The carburetor as defined in claim 9 wherein the fuel delivery means includes means for bleeding air into the fuel line to premix air with the fuel prior to the delivery of the fuel to the mixing chamber.

11. The carburetor as defined in claim 9 wherein the fuel delivery means includes for bleeding air into the fuel line to premix fuel prior to the delivery of the fuel to the mixing chamber in amounts inversely related to the liquid in the fuel well.

12. The carburetor as defined in claim 11 wherein the air bleeding means includes a variable flow restriction means formed in the fuel line communicating at least in part with an air space above the fuel level in the fuel well to enable air to be drawn from the air space through the variable flow restriction means into the fuel line to premix with the fuel before the fuel is directed into the mixing chamber.

13. The carburetor as defined in claim 9 wherein the fuel delivery means includes means for automatically controlling the fluctuation in the fuel level of the fuel well.

14. The carburetor as defined in claim 13 wherein the fuel level fluctuation control means includes variable flow restriction means between the fuel reservoir and the fuel well that is responsive to the liquid level in the fuel reservoir for bleeding air from an air space above the fuel reservoir into the fuel well in amounts inversely related to the liquid level in the fuel reservoir so that as the liquid level in the fuel reservoir moves downwardly, more air is bled into the fuel well to limit the fluctuation of the liquid level in the fuel well.

15. The carburetor as defined in claim 14 wherein the variable flow restriction means includes a plurality of vertically spaced apertures formed in a wall on the fuel well and communicating with the fuel reservoir for bleeding air from the fuel reservoir to the fuel well in relation to the number of apertures that are uncovered by the liquid in the fuel reservoir.

16. The carburetor as defined in claim 9 wherein the fuel line includes a plurality of fuel tubes extending into the fuel well and terminating below the liquid level therein and wherein the tubes extend from the fuel well to corresponding fuel discharge locations for discharging the fuel into the mixing chamber at the angularly spaced locations.

17. The carburetor as defined in claim 16 wherein the fuel well extends concentrically about the induction duct and wherein the fuel tubes extend into the fuel well at angularly spaced locations.

18. The carburetor as defined in claim 17 wherein the fuel reservoir extends concentrically about the induction duct.

19. The carburetor as defined in claim 18 wherein the fuel reservoir and the fuel well have a common annular wall.

20. The carburetor as defined in claim 19 wherein the common annular wall has a plurality of vertically spaced apertures formed therein for bleeding air from the fuel reservoir to the fuel well in amounts related to the number of apertures that are uncovered by the liquid in the fuel reservoir.

21. The carburetor as defined in claim 9 wherein the fuel delivery means includes a manifold pressure control reservoir communicating with the atmospheric pressure control reservoir and wherein a manifold pressure line extends from the induction duct downstream of the throttle valve to an air space in the manifold pressure control reservoir to apply the manifold pressure of the engine to the manifold pressure control reservoir.

* * * * *